US006371041B1

(12) United States Patent
Ness

(10) Patent No.: US 6,371,041 B1
(45) Date of Patent: Apr. 16, 2002

(54) VERSATILE BUOYANCY, ATTITUDE, HOVER, AND GLIDE CONTROL SYSTEM FOR UNDERSEA VEHICLES

(76) Inventor: C. Clifford Ness, 11 Willow La., East Lyme, CT (US) 06333

( * ) Notice: Subject to any disclaimer, the term of this patent is extended or adjusted under 35 U.S.C. 154(b) by 0 days.

(21) Appl. No.: 09/679,540

(22) Filed: Oct. 6, 2000

Related U.S. Application Data

(60) Provisional application No. 60/199,835, filed on Apr. 26, 2000.

(51) Int. Cl.[7] ..... B63G 8/22
(52) U.S. Cl. ..... 114/333; 114/331; 114/312
(58) Field of Search ..... 114/312, 313, 114/330, 331, 333, 245, 125

(56) References Cited

U.S. PATENT DOCUMENTS 3,131,664 A * 5/1964 McInvale ..... 114/333
3,463,108 A * 8/1969 Neumeier ..... 114/333
4,076,464 A * 2/1978 Pinney ..... 417/332
4,898,288 A * 2/1990 Erdbrink ..... 114/333
5,477,798 A * 12/1995 Ness ..... 114/65 R

* cited by examiner

*Primary Examiner*—Stephen Avila
(74) *Attorney, Agent, or Firm*—Low & Low

(57) ABSTRACT

An undersea streamline vehicle having a unique system for gliding ascent, gliding descent, both with and without engine power, and for hovering in the sea for exploratory or research purposes by the provision in the vehicle of buoyancy chambers or bladders offset from the vehicle center of gravity, wherein the chambers include a piston element in a cylinder open to the sea environment. A control system effects selected positioning of the piston, thereby to regulate inflow of the sea into the cylinder or expulsion of sea water from the cylinder, thereby to vary the buoyancy of the vehicle vis-à-vis its center of gravity to control the rate of glide of the vehicle upwardly or downwardly, or to attain a stationary hover position. Ailerons and tail planes facilitate controlled direction of travel. A compressed air system precludes leakage of seawater into the buoyancy chamber.

16 Claims, 3 Drawing Sheets

VERSATILE BUOYANCY, ATTITUDE, HOVER, AND GLIDE CONTROL SYSTEM FOR UNDERSEA VEHICLES

CROSS-REFERENCE TO RELATED APPLICATION

This application is based upon a prior U.S. Provisional Application Ser. No. 60/199,835 filed Apr. 26, 2000.

BACKGROUND OF THE INVENTION

In recent years there has been considerable interest in and development of submersible craft, as submarines or under sea exploratory and rescue vehicles as all levels of commercial and military research. The underwater frontier remains a huge and much unexplored portion of the earth, with vast riches in minerals, petroleum, seabed, plant, and aquatic life. Further, covering some 70% of the globe, facile access to and use of the underwater environment remains critical to national defense as well as to increased development of the same and its instructive geological lore, habitat study, seabed and seamount mapping, and the like.

Humankind's adventures into ocean depths and the sky above commenced and made great strides in the $20^{th}$ century. Nonetheless, advances in aviation and space have far exceeded progress under the sea. While there are substantial and fascinating similarities in atmospheric air travel and undersea travel, the latter has lagged in research and development, although submarine technology has moved forward from surface air-dependent undersea travel to deep-sea dwelling capability. With greater underwater serviceability, design concerns are shifting from the hydrodynamics of wave resistance and control at or near the surface to the need for uninterrupted hydrodynamic flow about the undersea vehicle, with reduced wetted surface.

Submarines, even in recent years with newer hull designs and nuclear and other power development, still essentially partake of an elongated cigar-like hull configuration with necessary planing surfaces for control, and a fin or sail to contain periscopes and masts.

Such hulls must be carefully designed to withstand deep-sea pressure as well as being volumetrically efficient. A generally flattened hull shape introduces or advances planing or gliding ability, and using the latent forces of gravity and buoyancy to induce a thrust forward. One such is shown, for example, in my U.S. Pat. No. 5,477,798 having a sleek, generally "manta ray" form with remarkable hull strength and carrying capacity.

Further, in exploration and utilization of ocean depths it becomes increasingly important that even the most advanced hull designs be associated with effective and reliable control systems to improve underwater maneuverability, including the ability to hover, or silently glide downwardly or upwardly, to achieve particular needs or missions.

While, as noted, there are certain similarities and relationships between air flight and sea hydrodynamics, it is evident that resistance to fluid flow about a submerged hull is greater than airflow resistance aloft, due to the higher viscosity of water than air. Further, as water is incompressible in sharp contrast to air, a moving undersea body creates more absolute displacement with concomitant greater resistance. As a consequence, the operation of submarines is dependent on ballasting and therefore is more comparable to that of a gas-filled blimp or dirigible, than to heavier-than-air aircraft.

It follows that design and control improvements as to undersea gliding, planing, maneuvering, and even hovering are needed, wherein aircraft are well advanced in these regards. While we have observed for eons the ability of fish to dive, leap, stop, and hover in the water, only recently have we been able to mechanically emulate them. Grade school science classes in past generations were rather inaccurately taught elements of submarine design. The common experiment at the time comprised a partially filled milk bottle containing an inverted test tube with sufficient air above the water level in the tube to float the test tube at the surface. The bottle was stoppered with a connection to a hydrometer bulb. Squeezing the bulb induced sufficient pressure in the bottle to compress the tube's air bubble, permitting additional water to enter through the bottom of the tube, whereby it would sink. The release of external pressure conversely increases the air volume, expelling a like amount of water, allowing the tube to resurface. This experiment in fact illustrates the fish-swimming bladder and is not current in submarine design.

In a submarine comparable air volumes are called "free surfaces", which present a risk in that loss of buoyancy in a descent is inherently accelerated. For this reason, submarine ballast tanks are always vented before submerging, and inaccessible voids are filled solidly.

This air volume concept was observed in a tropical fish aquarium and revealed that the fish swimming bladders enhanced their performance. By a simple expansion and contraction of its bladder, a "glass fish" was observed to rise, hover, and sink, independently of other movement. Obviously, the bladder's volume was precisely controlled by the fish, allowing it to descend from and return to the surface with little effort and a minimal change in buoyancy. Such capability in a submarine would greatly enhance submarine performance. Improvements in such control ability are necessary to undersea progress at any level.

Various techniques and structures in an effort to improve underwater control of submerged vehicles are typified in the prior art by U.S Pat. No. 3,946,685 to Chadbourne et al, U.S. Pat. No. 3,665,884 to Gustafson, U.S. Pat. No. 3,752,103 to Middleton, U.S. Pat. No. 3,667,415 to Robbins, U.S. Pat. No. 5,129,348 to Rannenberg et al, or U.S. Pat. No. 5,477,674 to Somers et al, U.S. Pat. No. 4,577,583 to Green, or U.S. Pat. No. 3,157,145 to Farris, among others. Also of interest is a J.S.N.A., Japan publication, "Study on the Hydrodynamic Characteristics of Circular Submarines", which generally suggests the capability of a vessel to glide while submerged. While these patents and publications provide diverse control teachings and systems, and lead toward improved underwater vehicles, the same do not provide a full measure of desirable underwater buoyancy, attitude, ascending and descending glide control, and the like for submarine or like undersea craft with improved laminar hydrodynamic flow. Thus, illustratively, the use in these patents of thrusters or jets for depth or attitude control has the hazard of agitating sea sediments, both disrupting the environment and sharply impeding already restricted underwater visibility. Similarly, the provision of lateral wing-like appendages overlooks the high resistance of wetted surfaces under water.

Buoyancy control is essential to safe and facile operation of all undersea craft, as submarines or submersible exploratory vehicles. Such control permits, for example, the use of the vehicle for recovery of heavy objects from the sea floor. See U.S. Pat. No. 3,292,564, to Lehmann by way of illustration. However, even the most pressure resistant hull is unavoidably compressed in extended deep sea descent, reducing both volume and buoyancy. Minimally, some compensation can be effected by pumping trim and drain systems. Using compressed gas to discharge ballast water, however, is not always desirable as the gas is further compressed by continued descent, is unable to fully expand at depth, and with decreasing effectiveness. In ascent, the compressed gas rapidly expands, which may and does cause a hazardous acceleration to the undersea vessel rising to the surface. The necessarily vented gas in such emergency surfacing would be lost and unrecoverable. See the U.S. Pat. No. 1,686,928 to Wardle and Rannenburg U.S. Pat. No. 5,129,348. There is a need for more rapid and positive buoyancy control.

In another area of underwater control, submarines establish trim with a fore and aft system of weight transfer to attain a desired longitudinal attitude. Weight transfers while underway are compensated for by diving plane angle adjustments until the fore-aft transfer of trimming water is needed to restore the planes to a neutral position. Seawater piping systems function both to admit seawater or to discharge it back to the sea. The efficiency of overboard discharge pumping is significantly reduced as depths increase. See illustratively, the system of Chadbourne U.S. Pat. No. 3,946,685.

SUMMARY OF THE INVENTION

As noted above, aircraft and undersea vehicles have certain similarities in moving through the respective fluids of air and water. The present invention embraces an undersea craft, as a submarine, which is able to "fly" under water much as airplanes fly above it and fish deftly maneuver within it, as well as hover in a substantially stationary position, as a helicopter or a fish. This is achieved by a unique integration of buoyancy adjustment, trim distribution, unique gliding body hull form, and glide and aileron control planes, for generating unpowered forward motion, both upwardly or downwardly. My prior U.S. Pat. No. 5,477,798 was an initial attempt to interrelate these elements into a hydrodynamic design to achieve precise maneuvering in a manner adaptable for both manned and remotely-operated commercial and recreational applications. other inventors have sought, at least in part, to attain such concepts, as in U.S. Pat. Nos. 1,668,928; 3,157,145; 3,292,564; 3,665,884; 3,946,685; 4,577,583; 5,159,348, and 5,477,674, inter alia.

The general hull shape of this invention is that of a lifting body, wherein it generates vertical forces for lift or descent, much as in an aircraft, or, for that matter, a sea creature as a skate or a ray. These forces are created by an airfoil contour, employing the Bernoulli Principle, and which generate forward thrust or movement of the vessel, which assist in countering positive or negative buoyancy.

As to hull proportions for airfoil contour, the above-noted Japanese publication stated that a 2-to-1 ratio of height to diameter was found optimum. The observations of a greater water resistance for a circular cross-section hull form in that publication may suggest that the hull cross-sectional profile is excessive in its resultant displacement of flow.

The present invention, however, uniquely embraces a ratio of length, width and heighth on the order of four-to-two-to-one (4-2-1 LWH) which is chosen primarily for its relative and improved airfoil configuration. This innovative hull form can be describes as "lozenge-shaped". Model testing has verified such a hull form performance to be competitive.

The submarine of this invention is provided with one or more, preferably two relatively large buoyancy chambers, which may also be termed as "swimming bladders", as are common most fish of the sea. The chambers or bladders are preferably sized for a displacement change of about 3%, and are minimally affected by depth excursion.

The buoyancy chambers or bladders are located forwardly of the submarine's center of buoyancy, thereby to enhance attitude control. These chambers employ power-operated pistons to vary the chamber displacement. While the displacement pistons in the chambers are open to the sea, they are adequately sealed to resist the pressure of the vessel's depth excursions, establishing a constancy of the chamber's buoyancy. Alternate means for piston actuation may be employed, however, as hydraulic, electric, or pneumatic. However, the availability and quick response of a hydraulic system is preferred. Should the pistons move to full extension, and the system design be exceeded by inadvertent depth excursion, the pistons are mechanically secured by self-actuated devices. Yet further, the drains of the buoyancy chambers are open to within the pressure hull boundary, are specifically isolatable, and are interconnected with an emergency air pressure system to assure against leakage and failure. While the primary buoyancy bladder or bladders are as indicated just forward of the center of buoyancy, the invention further contemplates using trim tanks disposed near the nose of the undersea craft and toward or adjacent the rear of the vehicle, thereby to provide further versatility of glide control and ship trim.

Some additional attitude control arrangements are deemed advisable and necessary for the efficient operation of the invention, and are best accomplished by coordinating the same with existing and known ship systems:

a. Trim and Drain System—pump operated, and generally employed for evacuation of bilges, and the transfer of fluids between internal tankage. Its high-pressure capability is necessary for the intake and discharging of sea water, and to correct for significant displacement changes, such as flooding.

b. Steering and Driving System—the same commonly employs hydraulically operated planes for vertical and horizontal changes of the vessel's direction.

c. Ballast Blow and Venting System—a ballast blow air system of known form is able to quickly void the ballast tanks of seawater through bottom-located flood valves, and also have mechanically operated ballast tank vent valves which are opened to vent all contained air, and thereby allow the vessels' submergence.

d. Ships Hydraulic Service System—commonly a principal source of power used to operate remote actuators, valves, winches, and other devices, enabling control thereof from a central location.

There are a number of pressure hull construction configurations which are adaptable to the instant buoyancy control system of this invention, including the clustered spherical chambers of my earlier patent, and as generally illustrated in the drawings. Other shapes include diverse toroidal, spherical, conical, or cylindrical structures, and various combinations thereof.

DETAILED DESCRIPTION OF THE PREFERRED EMBODIMENT

Figure 1A:
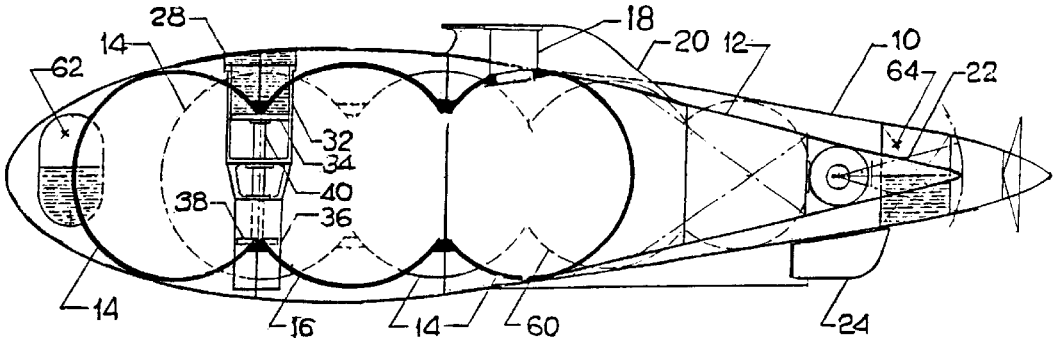
FIG. 1*a* is a diagrammatic cross-sectional showing of an illustrative undersea vehicle showing the location and relationship of the hover and glide control components in a static or hovering condition, and when underway under propulsion.
Figure 2:
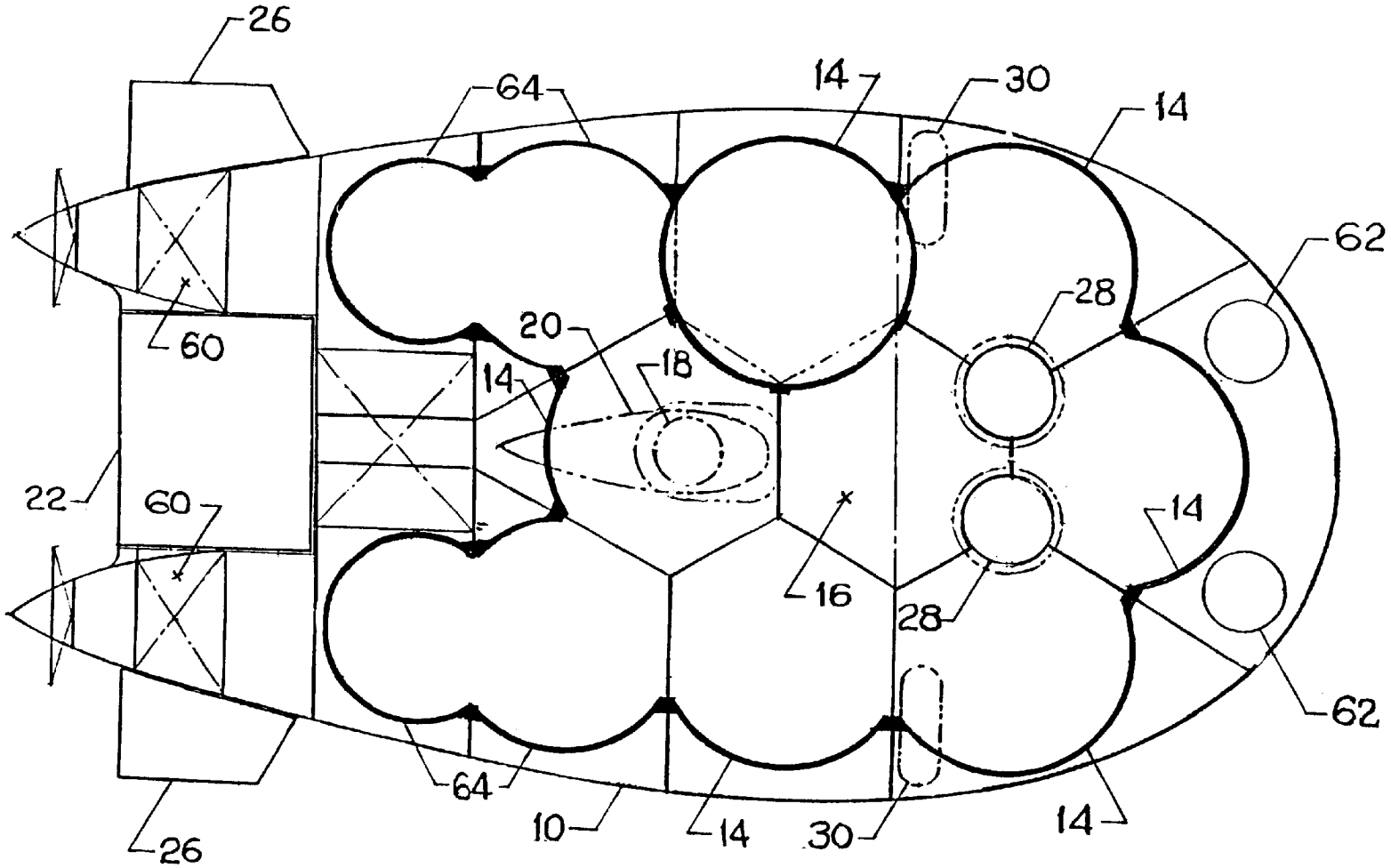
FIG. 2 is a general top plan diagrammatic view of the submarine showing the hover and glide components as arranged in a marine research submarine general arrangement of internal elements; better showing an internal clustered spherical construction as in U.S. Pat. No. 5,477,798; and, FIG. 3 is a diagrammatic system detail of a hydraulically operated buoyancy chambers, and showing the fluid line interrelationship with other ship systems.

To facilitate quick reference to the drawings and the following description, a glossary of reference numerals is as follows:

10—undersea vehicle or submarine
12—airfoil contour outer hull
14—clustered cell pressure hull
16—domed central compartment
18—hull access trunk
20—fairwater external structure
22—controllable stern plane
24—rudders
26—individual controllable ailerons
28—buoyancy adjusters
30—emergency ballast blow air tanks
32—buoyancy air cylinders
34—buoyancy air pistons
36—hydraulic actuating cylinders
38—hydraulic cylinder pistons
40—rods interconnecting pistons
42—self-actuated locking devices
44—hydraulic supply and return, above piston
46—hydraulic supply and return, below piston
48—manifold for variable buoyancy operation
50—three-position isolating valves
52—hydraulic supply header
54—hydraulic return header
56—emergency ballast air isolation valve
58—buoyancy air cylinder drain isolation valve
60—engine and machinery compartments
62—forward trim tanks
64—aft trim tanks Referring to the drawings, the general outline of the undersea vehicle 10 in accordance with the invention is seen generally in side elevation in FIGS. 1*a,* 1*b,* and 1*c,* and in plan view in FIG. 2, from which are evident the streamlined airfoil contour which generates forward and vertical moments as required for gliding. As seen in FIG. 2, the relatively short overall length (LOA) and relatively broad beam of the vessel establishes that planing surface necessary for the glide of the undersea vehicle. Additionally, the outer hull form has a reduced wetted surface area, thus lowering its frictional resistance.

In the diagrammatic views of the invention, those components contributing to the functionality and operation of the vehicle are shown. Details of control stations, crew quarters, power plants, etc., are not necessary for understanding of the invention.

The outer hull 12 of the vehicle 10 as seen in the drawings has an inner pressure hull comprised in the form shown of a cluster of six truncated spherical cells 14 disposed about a central domed compartment 16 (FIG. 2) which has a somewhat polygonal appearance from its intersections and connections to the surrounding cells 14. Additional pairs of aft cells 60 on port and starboard generally establish drive shaft centerlines, and contain the propulsion and ship's service machinery. These arrangements are similar to those in my prior U.S. Pat. No. 5,477,798 to which reference may be had for greater detail, wherein the several cells 14, 16, 60 contain various operating systems of the vehicle, as well as provide crew work stations, laboratories, galley, and sleep areas, for example.

The slipstream flow about hull 12 is interrupted only by an upper fairwater structure 20 in the nature of a vertical sail which includes the hull's access hatch at 18, and also by a pair of rearwardly extending lower skegs having the rudders 24 associated therewith.

Figure 3:
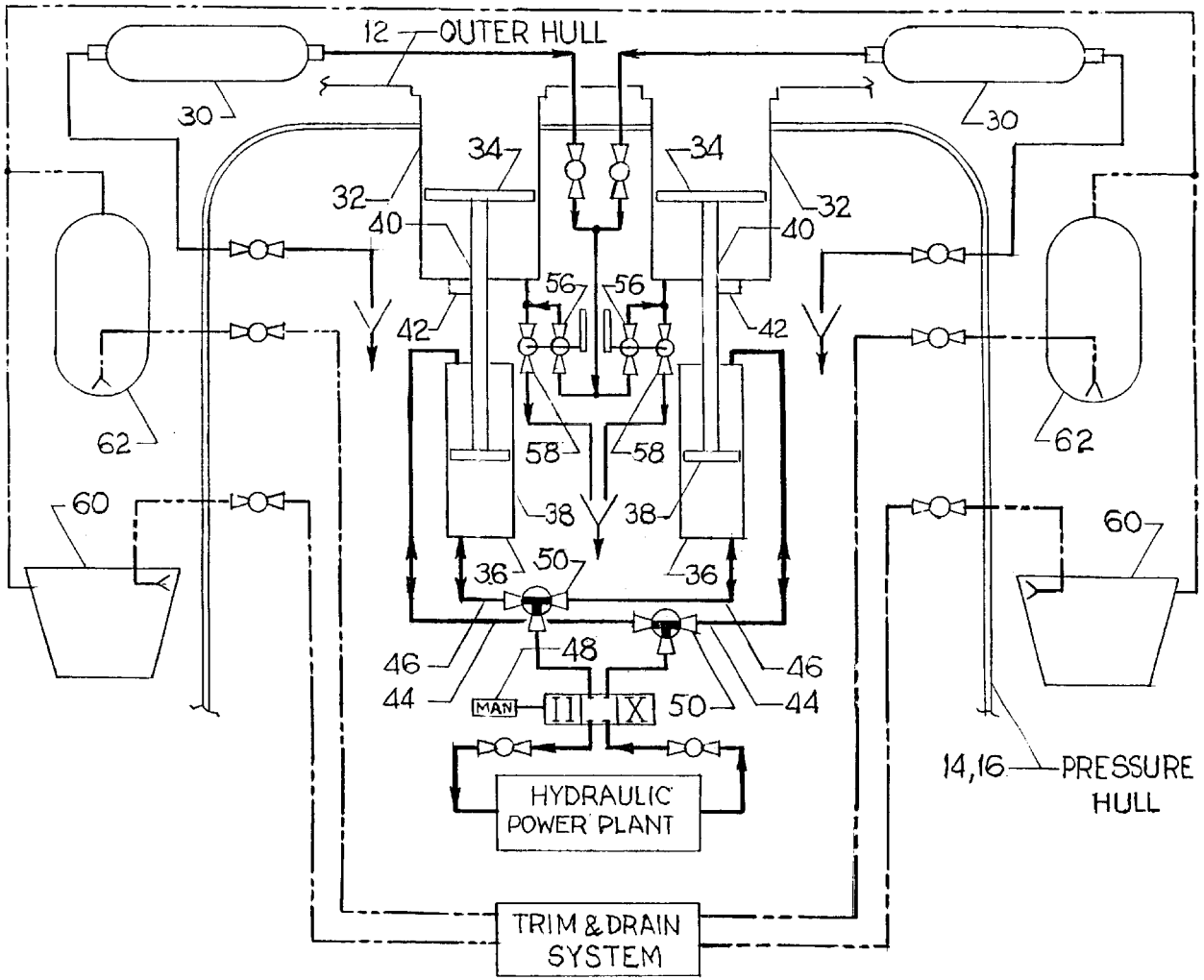

In the disclosed form of the invention, the buoyancy chambers 28, 28 are optimally placed forwardly of the static center of gravity "CG" as seen in FIGS. 1*a,* 1*b* and 1*c*. The fluid connections to the buoyancy adjusters 28 are seen in FIG. 3, as are also the emergency ballast blow air tanks 30, the forward trim tanks 62 and the aft trim tanks 64, which latter are also well seen in FIGS. 1*a–c*.

Figure 1B:
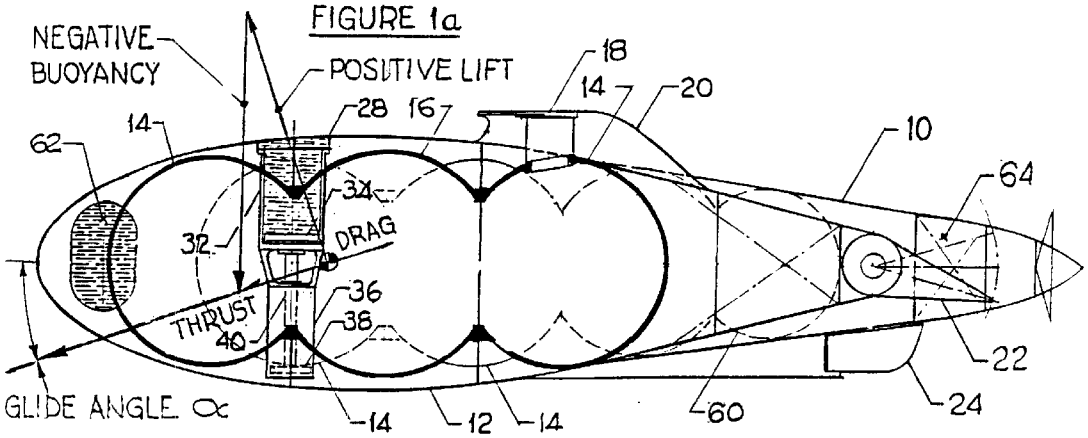
FIG. 1*b* is similar to FIG. 1, but showing the hover and glide control components as employed for an unpowered forward gliding descent.
Figure 1C:
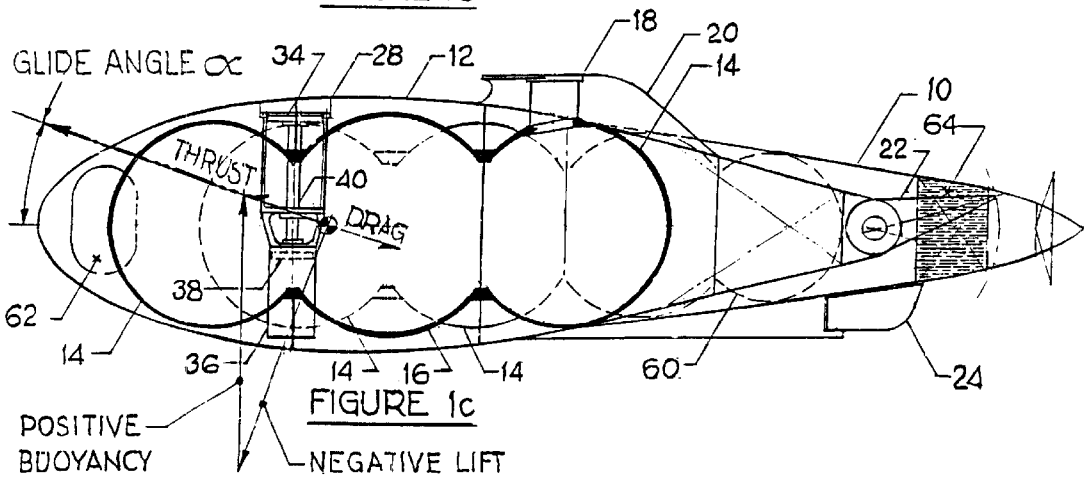
FIG. 1*c* is similar to FIG. 2, but showing the hover and glide control components as employed for an unpowered forward gliding ascent.

The hull is further provided with an aft horizontal plane 22 (FIG. 2) and aft port and starboard ailerons 26. These control surfaces act to reshape the vehicle's airfoil contour when angled up or down as seen in FIGS. 1*b* and 1*c,* whereby forward motion water flow tends to generate a downward thrust (FIG. 1*b*) or upward thrust (FIG. 1*c*). Other control means may be additionally provided as desired, as jet or fluid thrusters, for example, to augment or even replace the control surfaces.

Thus, in FIG. 1*b,* the vehicle is configured for a downward forward dive or descent with the rear planes 22 and the ailerons 26 angled downward, and, the upper air cylinder portion 32 of the buoyancy chambers 28 are flooded to initiate the descent, relocating the center of gravity CG forward and the center of buoyancy CB aft. As seen in FIG. 1*b,* the aft trim tanks 64 are voided into the forward trim tanks 62 to assist the descent and prevent stalling of the airfoils. The desired rate of gliding or powered descent is controlled by the positioning of the control surfaces, as well as by ballast adjustments.

Conversely, in FIG. 1*c,* for a gliding ascent, the relationships are reversed, with the buoyancy air chambers 32 evacuated, the planes and ailerons 22, 26 at an up angle, and the contents of the forward trim tanks 62 pumped aft to tanks 64, thereby relocating the CB forward and the CG aft. The ship would stay at level trim during the ascent/descent cycles and as maneuvered by its planes. Gliding in either direction is independent of positive engine propulsion to the screws.

As seen in the fluid connection diagram of FIG. 3, the buoyancy air cylinders 32 are fixed to the pressure hull shells 14, 16 in watertight manner and extend to the outer hull 12, with the outer face of the pistons 34 open to the sea. The piston rods or shafts 40 are interconnected between the air cylinder pistons 34 and the pistons 38 in hydraulic cylinders 36. Sufficient spacing is provided between the cylinders 32 and 36 to enable assembly, attachment, and maintenance. Hydraulic cylinders 36 are also fixed to and thereby integral with the hull in alignment with air cylinders 32.

The hydraulic supply 52 and return 54 headers are connected to the ship's steering and driving power plant (not shown), and supply the variable buoyancy chamber operating manifold 48. The manifold's three conventional positions extend, retract, or restrain the hydraulic pistons 38 for a positive control of the volumetric content of the buoyancy air chamber 32. The dual acting hydraulic supply and return headers attach, with alternating flow, to opposite chambers of the hydraulic actuation cylinders 36.

Some seepage past the air cylinder piston 34 may be anticipated after a period of normal use, and is continuously drained from cylinder 32 to a drain collecting tank within the pressure hull. Periodically, such drainage is evacuated via the ship's Trim and Drain System. Should this drainage become unacceptably frequent, or suffer failure before scheduled maintenance, one or both buoyancy adjusters 28 can be isolated and sealed by a charge from the emergency ballast blow air flask 30. In so doing, the hydraulic piston 38 must be fully extended and restrained, and the 3-position valving 50 reset to isolate the inoperative buoyancy chamber. The emergency ballast air charging valve 56 is interlocked with the buoyancy air cylinder drain valve 58 to assure the isolation of the submarine interior atmosphere from this high pressure air discharge. The adjustable buoyancy system of the invention, with two available chambers 28, is thus still able to operate at 50% capacity in an emergency mode with one chamber 28 shut down the piston shaft is held secure by a self-actuating locking or clamping device 42 disposed adjacent the shaft 40 between the air and hydraulic cylinders.

A unique advantage of the quick-acting buoyancy chamber system 28 of the invention is to enable a weight exceeding three percent of the ship's displacement to be salvaged from the ocean floor. The added buoyancy of the system coupled with the ship's variable ballast capacity, and a partial blowing of the ship's ballast tanks, in combination can extract and lift a significantly heavy salvage mass on the sea floor. In like manner, it is seen that any submerged weight is reduced by the weight of its displaced volume of water. Accordingly, this capacity can be employed to deliver material to a dive site, habitat, or undersea mining operation.

The undersea vehicle of the present invention, as most other submarines, is engineered under normal load to have a Center of Gravity at a point below the longitudinal axis, at CG in FIGS. 1*a,* 1*b* and 1*c*. The craft also has a Center of Buoyancy above the CG, shown as CB. Both of these should have a nearly common longitudinal location as seen in FIG. 1*a*. When at surface, the CB is significantly as above the CG, but when submerged, the ship's buoyancy and weight are equalized, bringing these two centers closer to each other, and making the vehicle relatively unstable fore and aft.

Operational weight redistributions must therefore be constantly recompensated with horizontal plane angle adjustments as the vessel is underway. When in hover, the horizontal planes are ineffective as the same require slipstream overflow for moment generation. In hover, and for significant weight redistributions, compensation is effected by transferring water fore and aft between the trim tanks 62 and 64. These tanks are isolated from sea pressure, and normally filled to about half volume when hovering or in normal operation.

The size of the buoyancy air cylinders 32, the hydraulic cylinders 36, the number thereof, and the stroke travel of the interconnecting piston shaft 40 are essentially determined by the displacement of the submarine and its required buoyancy differential. While the pressures of the ship's hydraulic and air systems are determined for the operational intent of specific submersibles, they also affect the present invention's capability for maneuver and depth. Only by way of illustration, the upper cylinder 32 open to the sea may have an inside diameter on the order of 48". As a consequence, the water displacement (or intake) weight and volume is substantial, which has a pronounced and determinable effect on the vehicle 10. In like manner, and illustratively, at a significant operating depth of about 3,000 feet, the sea pressure is on the order of 1,333 psig, while at a cruising depth of 4,500 feet, for example, the sea pressure is about 2,000 psig. For example, air pressure may be available at 4,500 psig for each chamber 28 to prevent seepage. The inventive system as disclosed herein employing pressures utilized in the present fluid art provide a faster operating, more depth capable, and more casualty responsive system than others now known and currently employed.

It is advantageous to provide the buoyancy chambers as shown as open to the sea along the streamline top surface of the hull as compared to a location on the hull bottom. Firstly, with the cylinder 32 on top, there is no likelihood of the ejection of seawater disturbing, occluding, or even damaging the seabed or objects thereon during research or recovery, as would occur on piston 34 movement with the cylinders opening downwardly on the bottom of the submarine. Secondly, the inrushing seawater will not ingest bottom sediments with the vessel at or adjacent to the sea floor.

While I have disclosed a preferred form of my invention, it is evident that the structures and concept thereof may be employed in other or similar undersea vehicles within the scope of the appended claims.

What I claim is:

1. An undersea vehicle having a buoyancy, glide and control system for underwater operation comprising:

an outer hull of airfoil-like configuration, a variable buoyancy chamber in said hull longitudinally offset from the center of gravity of the vehicle, said chamber having a pair of axially aligned cylinders including a piston in each cylinder, with said pistons being axially connected in spaced relation, a face of one of said pistons being open through said hull to the sea, an operating system for actuating the other of said pistons, a control system for said piston operating system thereby to regulate the position of said pistons and the buoyancy of said chambers by admission or expulsion of seawater from the cylinder having said one piston, and thereby said vehicle as said pistons are moved, whereby the vehicle may ascend, descend, or hover in accordance with the relative buoyancy of said chamber and resultant change in the center of buoyancy of the vehicle.

2. The undersea vehicle of claim 1 further including a second said buoyancy chamber proximate said first chamber, and having said piston operation control systems therefor.

3. The undersea vehicle of claim 1 further including movable external horizontal axis planes at the rear of the vehicle to assist in upward gliding movement of said vehicle when said first cylinder exposed to the sea is substantially evacuated.

4. The undersea vehicle of claim 1 further including movable external horizontal axis planes at the rear of the vehicle to assist in downward gliding movement of said vehicle when said first cylinder exposed to the sea is substantially filled with sea water.

5. The undersea vehicle of claim 2 further including a compressed air supply, and connections therefrom to said first cylinder having said piston exposed to the sea, and wherein with said second piston advanced in its cylinder water is expelled from said first cylinder having its piston open to the sea.

6. The undersea vehicle of claim 1 wherein said face of said first piston is exposed to the sea through the upper surface of said hull.

7. The undersea vehicle of claim 2 wherein said face of said piston in each of said first cylinder of said buoyancy chambers is exposed to the sea through the upper surface of said hull.

8. The undersea vehicle of claim 1 wherein said axially aligned cylinders are in spaced relation each other to provide working access to said cylinders therebetween.

9. The undersea vehicle of claim 3 wherein said buoyancy chambers are disposed forwardly of the vehicle center of gravity for improved control and stability.

10. The undersea vehicle of claim 2 wherein said buoyancy chambers have a displacement on the order of 3% of that of the undersea vehicle, thereby to permit lifting of substantial weights from the sea floor.

11. The undersea vehicle of claim 1 wherein the hull of said vehicle is of generally streamline airfoil and lozenge-like form fore to aft with the width thereof substantially greater than the height thereof to facilitate upward and downward gliding of the vehicle in response to buoyancy chamber operation.

12. The undersea vehicle of claim 10 wherein said piston of said first cylinder is open to the sea at the top streamline surface of the hull.

13. The undersea vehicle of claim 3 further including interconnected substantially spherical work and equipment cells in said hull accessible to personnel in said vehicle during gliding ascent, gliding descent, hover, and sea travel operations of said vehicle.

14. An undersea vehicle having a buoyancy, glide, and hover control system for underwater operation comprising:

an exterior streamline hull, a large capacity variable buoyancy chamber in said hull including a movable element open to the sea environment, said chamber being fully disposed forwardly of the center of gravity of the vehicle, a control system for moving said element to any point between an advanced position precluding entry of the sea into the said chamber, thereby to maximize the buoyancy of said vehicle for upward gliding movement, and a retracted position, maximizing entry of sea water into said chamber, thereby to reduce the buoyancy of said vehicle during descending gliding movement, whereby positioning of said movable element controls the relative buoyancy of said vehicle, thereby enabling gliding ascent, descent, and hover conditions of said vehicle in the sea.

15. The undersea vehicle of claim 14 further including an additional large capacity buoyancy chamber in proximate relation to said first chamber, and a said control system therefor.

16. The undersea vehicle of claim 14 further including a compressed air system connected to said element and on the other side thereof from the sea to assist in precluding seawater leakage into said buoyancy chamber.

* * * * *